US007547212B2

(12) United States Patent
Krumme

(10) Patent No.: US 7,547,212 B2
(45) Date of Patent: Jun. 16, 2009

(54) SLIPRING WITH A SLIDE TRACK FORMED AS A CLOSED CIRCUIT OF ELECTRICALLY RESISTANT MATERIAL

(75) Inventor: Nils Krumme, Feldafing (DE)

(73) Assignee: Schleifring und Apparatebau GmbH, Fuerstenfeldbruck (DE)

( * ) Notice: Subject to any disclaimer, the term of this patent is extended or adjusted under 35 U.S.C. 154(b) by 708 days.

(21) Appl. No.: 11/262,280

(22) Filed: Oct. 28, 2005

(65) Prior Publication Data

US 2006/0089009 A1 Apr. 27, 2006

Related U.S. Application Data

(63) Continuation of application No. PCT/EP2004/004056, filed on Apr. 16, 2004.

(30) Foreign Application Priority Data

Apr. 28, 2003 (DE) ..... 103 19 248

(51) Int. Cl.
*H01R 39/00* (2006.01)

(52) U.S. Cl. ..... 439/11

(58) Field of Classification Search ..... 439/11, 439/13, 18, 23, 24, 28; 455/41, 41.1; 375/258; 336/118, 130; 323/215
See application file for complete search history.

(56) References Cited

U.S. PATENT DOCUMENTS

| | | | | |
|---|---|---|---|---|
| 4,210,885 | A | 7/1980 | Ho | |
| 4,730,224 | A | 3/1988 | Komatsu | |
| 5,018,174 | A | 5/1991 | Collins | |
| 6,300,747 | B1 * | 10/2001 | Croce et al. | 323/215 |
| 6,351,626 | B1 * | 2/2002 | Lohr | 455/41.1 |
| 6,813,316 | B2 * | 11/2004 | Lohr | 375/258 |
| 6,897,756 | B2 * | 5/2005 | Haisch | 336/130 |

(Continued)

FOREIGN PATENT DOCUMENTS

| | | |
|---|---|---|
| CH | 206826 | 8/1939 |

(Continued)

OTHER PUBLICATIONS

International Search Report, PCT/EP2004/004056, mailed Aug. 20, 2004.

*Primary Examiner*—Chandrika Prasad
(74) *Attorney, Agent, or Firm*—Kevin L. Daffer; Daffer McDaniel, LLP

(57) ABSTRACT

A device such as a slide track or a slipring for transmitting electrical energy or signals between at least two units that are rotatable relative to each other along a path of rotation comprises at least one slide track formed as a closed circuit of electrically conducting material disposed along the path of rotation, and at least one tap movable along the slide track for coupling electrical signals into the slide track from one of the units, or coupling electrical signals out of the slide track to one of the units. In order to reduce a superposition of signals that have traveled along different directions along the closed circuit, the at least one slide track is configured to have electric losses resulting in an amplitude of an electrical signal coupled into the slide track being reduced by at least 6 dB, preferably 10 dB, during a passage of the signal along one entire length of the slide track.

9 Claims, 4 Drawing Sheets

U.S. PATENT DOCUMENTS

| | | | | |
|---|---|---|---|---|
| 6,950,003 | B2 * | 9/2005 | Ahulwalia et al. | 336/130 |
| 7,277,675 | B2 * | 10/2007 | Lohr et al. | 455/41.1 |
| 2002/0122497 | A1 | 9/2002 | Lohr | |

FOREIGN PATENT DOCUMENTS

| | | |
|---|---|---|
| DE | 4006007 | 8/1990 |
| DE | 4217425 | 12/1993 |
| DE | 4412958 | 10/1995 |
| DE | 19533819 | 3/1996 |
| EP | 0221401 | 10/1986 |
| WO | 98/29919 | 7/1996 |

* cited by examiner

SLIPRING WITH A SLIDE TRACK FORMED AS A CLOSED CIRCUIT OF ELECTRICALLY RESISTANT MATERIAL

CROSS REFERENCE TO RELATED APPLICATIONS

This application is a continuation of pending International Application No. PCT/EP2004/004056 filed Apr. 16, 2004, which designates the United States and claims priority from pending German Application No. 103 19 248 filed on Apr. 28, 2003.

BACKGROUND OF THE INVENTION

1. Field of the Invention

The invention relates to systems for electrical transmission between two units that are movable relative to each other. These are used, for example, in the form of linear slide tracks in linearly movable units such as crane systems, or as sliprings for rotating data transmission, for example in machine tools or computer tomographs.

2. Description of the Related Art

Both contacting and non-contacting transmission techniques are known for sliprings or slide tracks. Because sliprings for rotating data transmission, and linear or curved slide tracks operate on the same technical principle, no distinction will be made between them in the following exposition. The terms will be used as being synonymous.

The manner of operation of electrical signal transmission will be briefly explained in the following, using a slipring as an example. Circular or annular slide tracks are mounted in a first unit. A second unit moving relative to these has a sliding contact resting upon a slide track with which it is in sliding contact during the movement. An electric current can now be transmitted via this galvanic contact. As an alternative to a sliding contact, a non-contacting tap is also possible. In this case, the coupling is preferably capacitive or inductive, for example via a field probe. Non-contacting transmissions of this kind are preferably used for medium to high frequencies. Although the term "slide tracks" is being used here, it is intended to apply to those which are basically suitable for non-contacting or for contacting transmission. Furthermore, no distinction will be made between transmissions of electrical signals and energy, because in both cases the mechanisms of transmission are basically the same.

Particularly in the case of medium and high frequency signals, a problem with the arrangements is that of transmitting these signals along a slide track with as little interference as possible. With slide tracks as normally used, only electrical signals can be transmitted that have a wavelength which is large compared with the electrical path along the slide tracks. With small devices, for example with sliprings having diameters of only a few millimeters, as a rule the length of a slide track can be neglected, so that high bandwidths may be achieved here. With large arrangements, for example with sliprings as used. in computer tomographs and having a circumference of more than 5 meters, only relatively low bandwidths can be achieved.

A solution described in the U.S. Pat. No. 5,018,174 improves the transmission characteristics of the slide tracks. Here a terminal resistor is disposed at a position diametrically opposite to the feed-in position. The disadvantage of this arrangement is that in fact no reflection-free termination can be achieved because of this so-called terminal resistor. Reflections still occur at the position of the so-called terminal resistor and lead to interference with the signal. Furthermore, and particularly with feeding-in of signals from the second unit, a further movable tap (brush or brush block) must be provided on the second unit. This further tap is disposed to be diametrically opposite (displaced by 180 degrees from the coupling-in position). Thus, with an arrangement of this kind two movable taps are always needed. This results in increased costs in production, and increased wear in the case of a sliding contact arrangement. In fact, any advantage provided by the increased outlay is only very limited.

Furthermore, non-contacting transmission systems are known from prior art, for example from DE 44 12 958, which have no closed conductor path. Thus, with these the conductor path is interrupted at least at one position. This is acceptable for non-contacting transmission. These conductor paths may be terminated to be free from reflections by connecting to each end a resistor corresponding to the characteristic impedance of the conductor path. With this, a signal fed-in at an arbitrary location along the conductor path can propagate along both directions, starting from the feeding-in location, as far as each one of the terminated ends. There it will be finally absorbed and can therefore no longer be reflected back into the conductor path. If the signal were to be reflected, then it would be received a second time by the receiver. Multiple receptions of this kind can result in an impairment extending up to massive interference with the transmission. However, slip rings which preferably have a brush running along a slide track cannot be manufactured economically to include a discontinuity Thus, for example, increased brush wear will occur at the site of the discontinuity. Furthermore, a closed track is preferred also for reasons of fabrication technology, because with this, mechanical strains are uniformly distributed around the circumference. Finally, when a brush passes a site of discontinuity of this kind, a short-circuiting of the discontinuity will occur and at least for a brief moment of time lead to exactly the signal interference which it was intended to avoid. In the case of high data rates of several 100 Mbit/s, this can lead to large losses of data.

SUMMARY OF THE INVENTION

The invention is based on the object of improving sliprings or slide tracks in such manner that, in comparison with prior art, they exhibit improved signal transmission properties, in particular reduced reflections, and are simpler and more economical to manufacture.

This object is achieved in accordance with the invention by a device for transmitting electrical signals or energy between at least two units that are rotatable relative to each other along a path of rotation, comprising: at least one slide track formed as a closed circuit of electrically conducting material disposed along the path of rotation; and at least one tap movable along the slide track for coupling electrical signals into the slide track from one of the units, or coupling electrical signals out of the slide track to one of the units; wherein at least one slide track is configured to have electric losses resulting in an amplitude of an electrical signal coupled into the slide track being reduced by at least 6 dB, preferably at least 10 dB, during a passage of the signal along one entire length of the slide track.

The object is also achieved in accordance with the invention by a slide track for transmitting electrical signals or energy between at least two units that are rotatable relative to each other along a path of rotation, wherein the at least one slide track is configured to have electric losses resulting in an amplitude of an electrical signal coupled into the slide track being reduced by at least 6 dB, preferably at least 10 dB, during a passage of the signal along one entire length of the slide track.

BRIEF DESCRIPTION OF THE DRAWINGS

In the following the invention will be described by way of example, without limitation of the general inventive concept, on examples of embodiment with reference to the drawings.

DETAILED DESCRIPTION OF THE INVENTION

Figure 1:
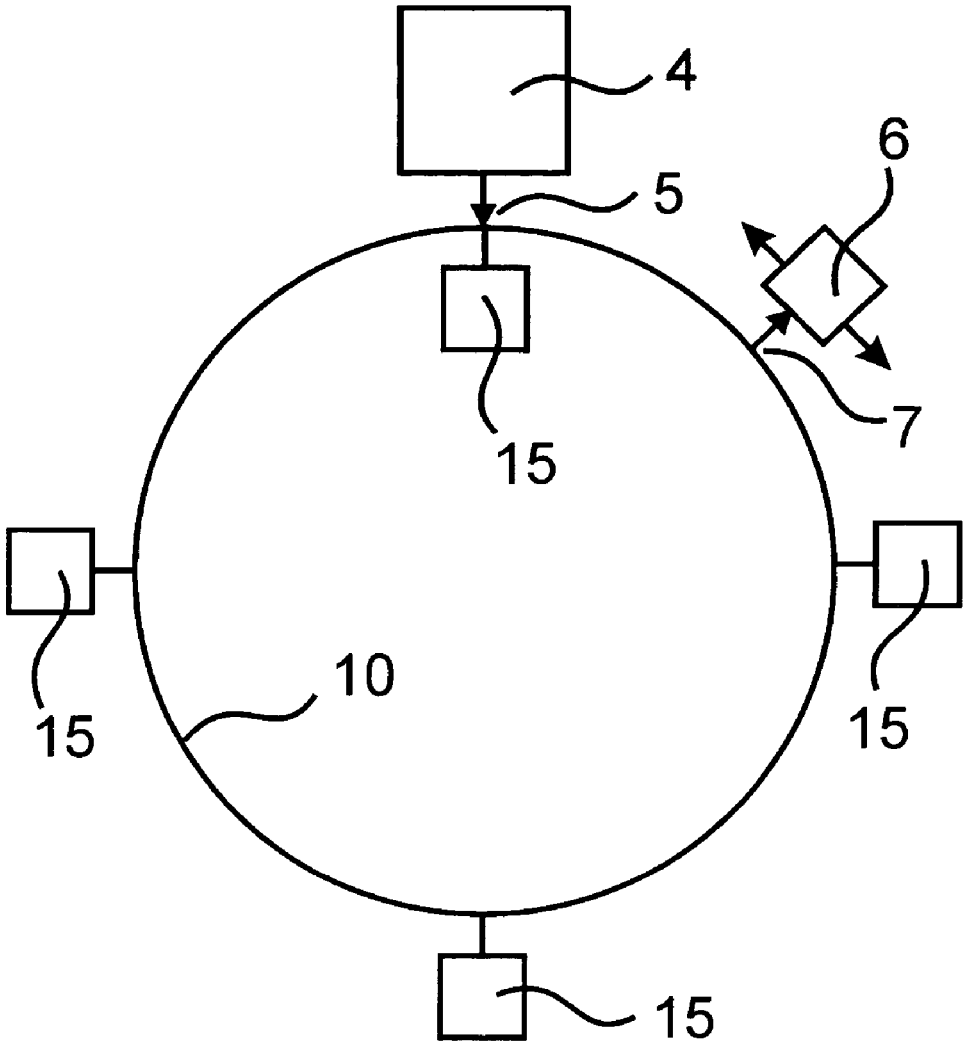
FIG. 1 schematically shows in a general form an arrangement in according to the invention.

A device according to the invention for transmitting electrical signals or energy between at least two units that are moveable relative to each other comprises: at least one preferably circular and closed slide track of electrically conductive material disposed along a path of movement, and also at least one tap moveable along this slide track for coupling electrical signals in or out. Slide tracks in accordance with the invention cause an attenuation along their extent, which results in an attenuation of a signal transmitted via the slide track.

The prior art up to the present is based on a signal being transmitted via a slide track with as few losses as possible, and the slide track being terminated to be as free as possible from reflections at a discrete location. Investigations have shown that especially with closed slide tracks, a termination that is free from reflections cannot be achieved. However, closed slide tracks may be fabricated particularly economically, and are subject to substantially less wear of contact brushes, in particular when tapping is effected by contact. With discontinuous slide tracks, higher wear results from contact brushes having to pass across at least one threshold or groove. However, if a groove of this kind is dispensed with for reasons of wear, then even the rotating taps known from the above-cited prior art are only inadequately effective.

Contrary to this, the invention pursues a basically different approach. The slide tracks themselves are designed to be attended by losses, so that the signal is weakened already when traveling along the slide tracks. Thus, terminating resistors on the slide tracks can be dispensed with. Any reflections at the ends of open slide tracks or at other locations of irregularities are weakened and thus only unsubstantially affect the signal to be transmitted. Of course, a slide track according to the invention may be used not only with sliding brushes, but also with non-contacting taps. It is essential to the invention for a closed path or slide track to be involved. An attenuation of the slide track must now be so large that an electric signal is significantly weakened along one complete circumferential passage and does not substantially falsify the original signal. Tests have shown that the attenuation must be larger than 6 dB along one complete circumferential passage. An attenuation greater than 10 dB is of advantage. If, particularly with slip-rings, a signal is weakened by 6 dB, i.e. to one half of the amplitude of the signal voltage along the course, then despite the presence of any superposition on the actually received signal, an unequivocal evaluation of the signal will still be possible. Here higher values of attenuation result in better signal quality. However, owing to the attenuation by the slide tracks, the amplitude of a received signal will also be diminished, so that here the optimum attenuation of a slide track must be determined from case to case.

A slide track in accordance with the invention for transmitting electrical signals is therefore attended by losses, so that it attenuates a transmitted signal to reduce the signal amplitude by at least 6 dB, preferably 10 dB, upon passing along the entire length of the slide track.

In an especially advantageous embodiment of the invention, the slide tracks comprise resistor material. Resistor materials of this kind are, for example, carbon, ceramic-metal compounds, and metal alloys of high ohmic resistance. When designed in this manner, the slide tracks themselves will give rise to the losses which attenuate the transmitted signals.

Another advantageous embodiment of the invention consists in the slide tracks being additionally provided with attenuating resistors. Thus, conventional slide tracks may be used in which an attenuation is created by supplementing the circuit with additional attenuating resistors. These additional attenuating resistors must have at least one component subject to losses. In addition, they may comprise inductive or capacitive components With this, frequency-dependent attenuation may be achieved. In accordance with the invention, the attenuating resistors are connected in parallel between two slide tracks, or from one slide track to a ground track or ground surface.

In another advantageous embodiment of the invention, the number of attenuating resistors is greater than two. In accordance with the invention, it is not intended to effect exclusively a termination of the slide tracks, but rather than this, to achieve an attenuation along the course of the slide tracks. For this, at least three attenuating resistors are needed. With a larger number of attenuating resistors the course of the attenuation becomes more continuous, and the reflections at the locations of the attenuating resistors diminish. However, costs of fabrication will also rise with the number of attenuating resistors. Tests for optimizing the transmission characteristics have shown that a substantial improvement over prior art already may be achieved with 3, 4, or even 5 attenuating resistors.

In another advantageous embodiment of the invention, the attenuating resistors are uniformly distributed along the length of the slide tracks. Thus, a uniform variation of the attenuation is achieved. However, the variation of the attenuation could also be conformed to special requirements. Thus, a large number of attenuating resistors could be mounted at particular locations. Preferably the attenuating resistors all have the same value.

In another advantageous embodiment of the invention, the attenuating resistors are optionally disposed in series or in parallel to the slide tracks. A connection in parallel with known slide tracks, be they slide tracks constructed of solid brass, or in printed circuit technology, is particularly simple. For this, strip conductors need not be discontinuous. Attenuating resistors may also be disposed in series with slide tracks (preferably at locations of discontinuity), a gap then being closed by the attenuating resistor. However, substantially larger attenuation with simultaneously better impedance matching may be achieved with a combined series and parallel circuit. Dimensioning may be made here, for example, in accordance with known attenuating members (T members or Pi members).

FIG. 1 shows in a schematic form a device according to the invention. A slide track 10 serves to transmit electrical signals. Of course, in practice arrangements are used consisting of a plurality of slide tracks, as shown for example in FIG. 2 or 3. However, for the sake of simplicity, reference will be made in the following expositions to only one slide track 10. Here by way of example, an arrangement with a transmitter that is firmly coupled to the slide track, and a receiver that is disposed to be moveable thereto, will be explained. The directional arrow indicates the possible directions of movement. Of course, the subject matter of the invention can also be applied to arrangements in which, for example, the transmitter is disposed to be movable relative to the slide track, and the receiver is firmly connected thereto. Similarly, both the transmitter and the receiver may be disposed to be movable relative to the slide track. At a coupling-in location 5 a signal is coupled into the slide track 10 by the transmitter 4. At its actual position which is a coupling-out location 7, a movably disposed receiver 6 couples out a received signal from the slide track. Furthermore, by way of example, 4 attenuating resistors 15 are here disposed at various locations along the slide track. The effect is as follows: a signal fed-in at the coupling-in position will propagate in both directions along the annular-shaped slide track. After a short time a signal component propagating in a clockwise direction will reach the coupling-out location 7 with relatively small attenuation. Another signal component propagating in the opposite direction will reach the coupling-out location 7 after a delay, and with significant attenuation by the slide track 10 that is subject to electric loss. Thus, this second signal will hardly affect the first signal.

Figure 2:
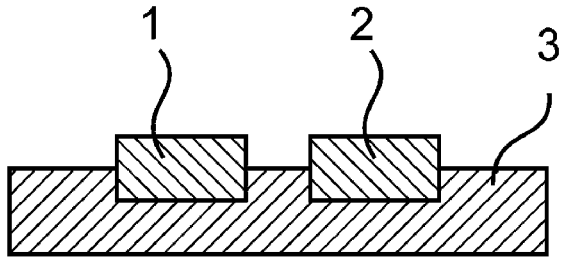
FIG. 2 shows a symmetrical conductor arrangement.

FIG. 2 illustrates by way of example a typical structure of a conductor system consisting of two slide tracks 1 and 2 forming a line, and serving to conduct electrical signals. Both slide tracks are mounted in a support made of a dielectric 3. A conductor arrangement of this kind is preferably used to transmit symmetrical signals.

Figure 3:
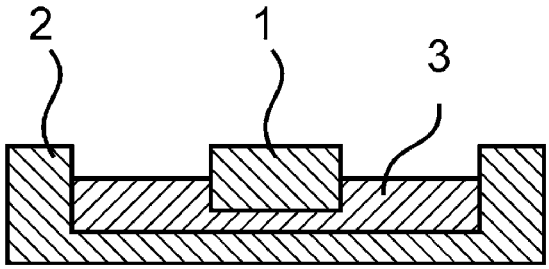
FIG. 3 shows an unsymmetrical conductor arrangement.

FIG. 3 illustrates by way of example another arrangement in the form of a non-symmetrical conductor system. In this, an external conductor 2 and also an internal conductor 1, separated from each other by a dielectric 3, are provided.

Figure 4:
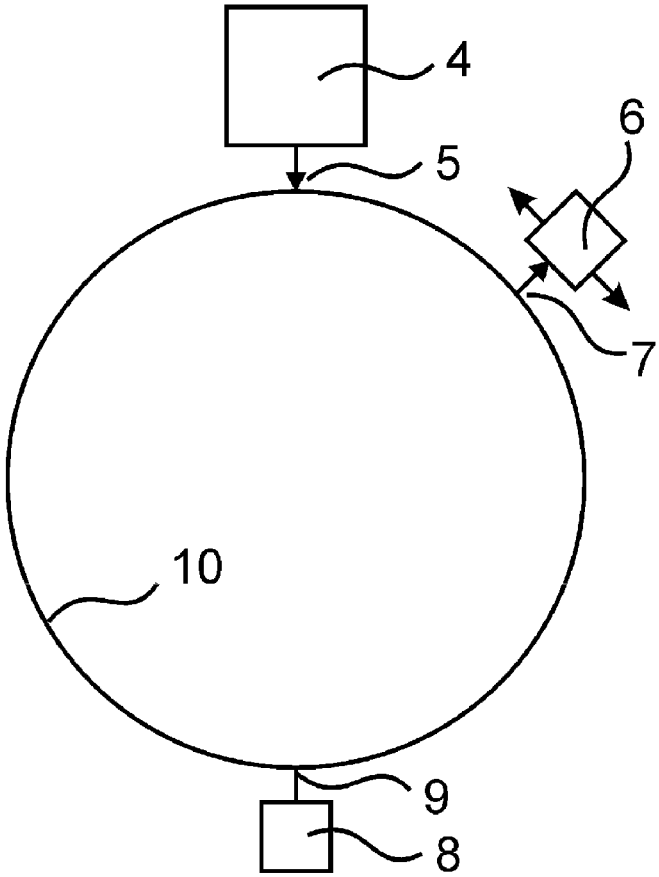
Fig. 4 (prior art)
FIG. 4 shows an arrangement according to prior art.

FIG. 4 illustrates a slipring arrangement according to prior art. A closed slide track 10 has a transmitter 4 at a coupling-in location. A termination 8 is disposed at a diametrically opposite terminating location 9. A signal tap is effected at a coupling-out location 7 by means of a movably disposed receiver 6.

Figure 5:
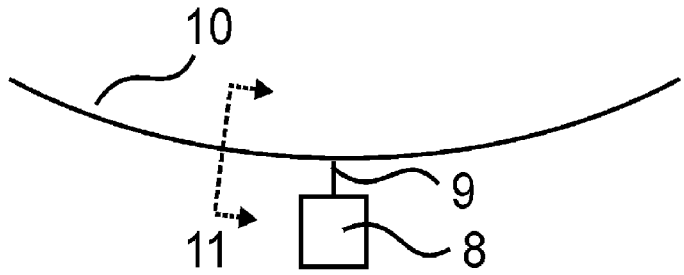
Fig. 5 (prior art)
FIG. 5 shows a termination of a closed slide track.

FIG. 5 illustrates an arrangement of a termination at a closed slide track 10. In this, the termination 8 is disposed at a connecting location. The arrows 11 indicate a section through the slide track 10, to which reference will be made later.

Figure 6:
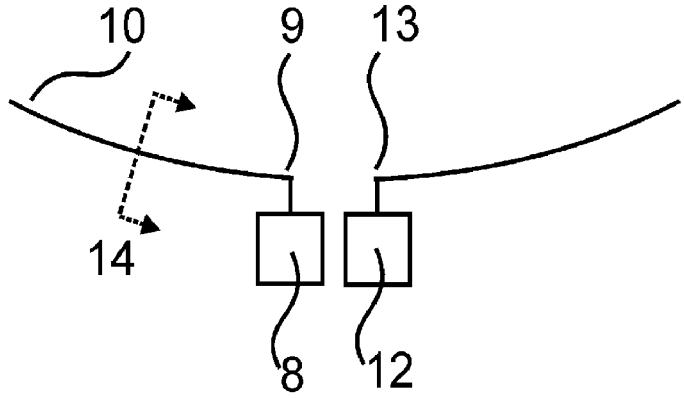
Fig. 6 (prior art)
FIG. 6 shows a termination of a discontinuous slide track.

FIG. 6 shows an arrangement corresponding to that of FIG. 5 of a termination at a discontinuous slide track 10. Each of the two ends of the slide track are connected to the terminations 8 and 12 at the terminating locations 9 and 13. A section through the slide track 10 is denoted by arrows 14.

Figure 7:
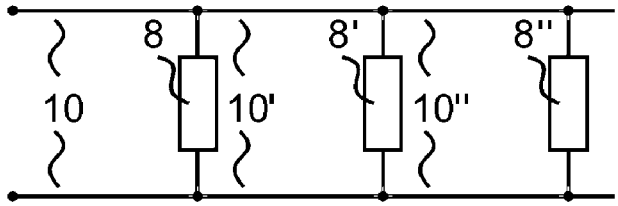
Fig. 7 (prior art)
FIG. 7 shows an equivalent circuit diagram of an arrangement according to prior art with a closed slide track.

FIG. 7 schematically shows an equivalent circuit diagram of a closed conductor arrangement according to prior art, which has a termination corresponding to that of FIG. 5. Consideration of the electrical impedances is made along the direction of a sectional arrow 11. If now the impedances of the slide track are considered by starting out from the base of the arrows 11, then the following arrangement becomes evident:

a portion of the slide track 10 is followed by
the termination 8, followed by
the entire slide track 10, denoted here by 10' for the sake of clarity of illustration, followed by
the termination 8 through which the electric wave passes a second time, and which is here accordingly denoted by 8'.

Further passes are once more made through the slide track 10 and also the termination 8, which are here denoted by 10" and also 8", respectively, for a second complete pass.

With this arrangement a termination free from reflection cannot be achieved, because the termination 8 is again followed by the slide track 10. This results in a parallel connection of the impedance of the termination 8, and also of the transformed impedance of the line 10. Furthermore, in theory the wave can pass through the line any desired number of times. However, it is weakened to a certain extent from one pass to the next. Nevertheless, here too in practice it is possible to detect a distinct superposing of signals that are displaced in time with respect to each other according to the transit time along the entire length of the slide track 10.

Figure 8:
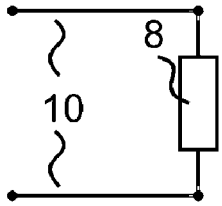
Fig. 8 (prior art)
FIG. 8 shows an equivalent circuit diagram of an arrangement according to prior art with a discontinuous slide track.

FIG. 8 shows an equivalent substitute circuit diagram of a corresponding arrangement having a discontinuous slide track 10 as in FIG. 6. In this, it is evident that when starting out from the base of the sectional arrow 14, there is a portion of the slide track 10 that is closed off by the termination 8. In this case, a termination that is substantially free from reflection can in fact be achieved. For this, however, the slide track must be discontinuous, and furthermore, no arrangement having a transmitter that is mobile relative to the slide track can be achieved, because the discontinuity must be disposed to be exactly opposite to the transmitter. For an explanation of this effect, attention is drawn to U.S. Pat. No. 5,018,174, the contents of which are incorporated by reference in the present document.

Figure 9:
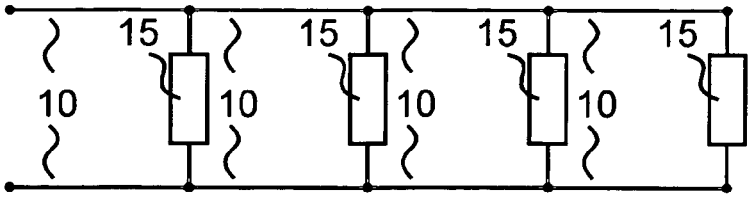
FIG. 9 shows an equivalent circuit diagram of an arrangement according to the invention with attenuating resistors connected in parallel.

FIG. 9 illustrates an equivalent circuit diagram of an arrangement according to the invention with attenuating resistors connected in parallel. In correspondence with the sections from FIGS. 5 and 6, the result is a series connection of portions, each being short, of a slide track 10 followed by attenuating resistors 15. Here the attenuating resistors are disposed to be parallel to the portions of the slide track 10. In the case of FIG. 2 for example, this would involve the two slide tracks 1 and 2 being connected together with an attenuating resistor. Analogously, in FIG. 3 the inner slide track 1 would be connected to the slide track 2 surrounding it. Here the portions of the slide track are substantially shorter than the entire length of the slide track 10. Thus, a signal that is fed into the slide track 10 will already be substantially attenuated by a short portion of slide track, without having to pass repeatedly along the entire length of the slide track 10, as was set out above. Thereby interference owing to a superposition of time-delayed signals which arise from multiple passes along the entire ring is excluded.

Figure 10:
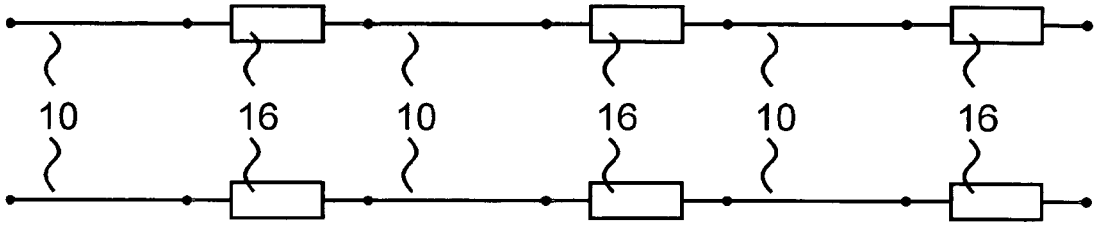
FIG. 10 shows an equivalent circuit diagram of an arrangement according to the invention with attenuation resistors connected in series.

FIG. 10 shows an equivalent circuit diagram of a device according to the invention and analogous to that of FIG. 9. However, instead of parallel resistors, the attenuating resistors 16 are connected to be in series with the conducting portions of the slide track 10.

Figure 11:
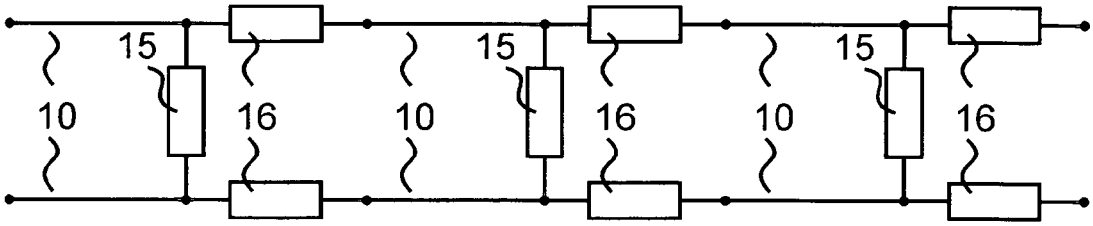
FIG. 11 shows an equivalent circuit diagram of an arrangement according to the invention with attenuating resistors connected in series and additionally in parallel.

Finally, FIG. 11 shows an equivalent circuit diagram analogous to that of FIG. 9 and FIG. 10, in which attenuating resistors are connected in series and in parallel to the conducting portions.

The invention claimed is:

1. A device for transmitting electrical signals or energy between at least two units that are rotatable relative to each other along a path of rotation, comprising:

at least one slide track formed as a closed circuit of electrically conducting material disposed along the path of rotation;

at least one tap movable along the slide track for coupling electrical signals into the slide track from one of the units, or coupling electrical signals out of the slide track to one of the units; and wherein the at least one slide track comprises an electrically resistant material that produces electric losses, which reduce an amplitude of an electrical signal coupled into the slide track by at least 6 dB during a passage of the signal along one entire length of the slide track.

2. The device according to claim 1, wherein the electrically resistant material is selected from carbon and ceramic-metal compounds.

3. The device according to claim 1, wherein the at least one slide track is provided with attenuating resistors.

4. The device according to claim 3, wherein the number of attenuating resistors is larger than two.

5. The device according to claim 3, wherein the attenuating resistors are uniformly distributed along the entire length of the at least one slide track and are of approximately the same value.

6. The device according to claim 3, wherein the attenuating resistors are disposed in series or in parallel to the at least one slide track.

7. The device according to claim 1, wherein the electrically resistant material of the at least one slide track produces electric losses, which reduce an amplitude of an electrical signal coupled into the slide track by at least 10 dB during a passage of the signal along one entire length of the slide track.

8. A slide track for transmitting electrical signals or energy between at least two units that are rotatable relative to each other along a path of rotation, wherein an electrically resistant material of the slide track produces electric losses, which reduce an amplitude of an electrical signal coupled into the slide track by at least 6 dB during a passage of the signal along one entire length of the slide track.

9. The slide track according to claim 8, wherein the electrically resistant material of the slide track produces electric losses, which reduce the amplitude of the electrical signal coupled into the slide track by at least 10 dB during a passage of the signal along one entire length of the slide track.

* * * * *